US007583030B2

(12) United States Patent
Varanasi et al.

(10) Patent No.: US 7,583,030 B2
(45) Date of Patent: Sep. 1, 2009

(54) DOPANT-FREE TUNGSTEN ELECTRODES IN METAL HALIDE LAMPS

(75) Inventors: Chakrapani V. Varanasi, Dayton, OH (US); Timothy R. Brumleve, Urbana, IL (US); Abbas Lamouri, Aurora, OH (US); Ajaypal Naruka, Twinsburg, OH (US)

(73) Assignee: Advanced Lighting Technologies, Inc., Solon, OH (US)

( * ) Notice: Subject to any disclaimer, the term of this patent is extended or adjusted under 35 U.S.C. 154(b) by 0 days.

(21) Appl. No.: 10/895,288

(22) Filed: Jul. 21, 2004

(65) Prior Publication Data

US 2005/0052134 A1 Mar. 10, 2005

Related U.S. Application Data

(60) Provisional application No. 60/488,348, filed on Jul. 21, 2003.

(51) Int. Cl.
*H01J 17/20* (2006.01)
*H01J 61/18* (2006.01)

(52) U.S. Cl. ..... 313/640; 313/633; 313/638; 313/641; 313/642

(58) Field of Classification Search ..... 313/633, 313/640, 568
See application file for complete search history.

(56) References Cited

U.S. PATENT DOCUMENTS

| | | | | | |
|---|---|---|---|---|---|
| 3,067,357 | A * | 12/1962 | Fridrich | 313/633 |
| 3,937,996 | A * | 2/1976 | Cap | 313/631 |
| 4,105,908 | A * | 8/1978 | Harding et al. | 313/631 |
| 4,199,701 | A * | 4/1980 | Bhattacharya | 313/25 |
| 4,340,836 | A * | 7/1982 | Bergman et al. | 313/631 |
| 4,893,057 | A * | 1/1990 | Tillman nee Caruso et al. | 313/631 |
| 5,057,743 | A * | 10/1991 | Krasko et al. | 313/639 |
| 5,530,317 | A * | 6/1996 | Willemsen et al. | 313/633 |
| 5,811,941 | A * | 9/1998 | Barton | 315/307 |
| 6,369,522 | B1 * | 4/2002 | Collins | 315/291 |
| 6,469,445 | B1 * | 10/2002 | Nortrup et al. | 313/638 |
| 6,590,340 | B1 * | 7/2003 | Eijsermans et al. | 313/623 |
| 6,705,914 | B2 * | 3/2004 | Tsutatani et al. | 445/50 |
| 2003/0020409 | A1 * | 1/2003 | Kelly et al. | 313/640 |
| 2004/0070322 | A1 * | 4/2004 | Ishigami et al. | 313/112 |

FOREIGN PATENT DOCUMENTS

| | | | |
|---|---|---|---|
| JP | 57197740 | A * | 12/1982 |
| JP | 2000340174 | A * | 12/2000 |

OTHER PUBLICATIONS

"Changes in Dose Composition at Different Stages of Life in Metal Halide Lamps Containing NaI-ScI3-ThI4," by Varanasi et al., Proceedings of the 9th International Symposium on the Science and Technology of Light Sources, p. 383, Aug. 2001.*

"Transport Processes in Metal Halide Gas Discharge Lamps," by W. van Erk, Pure App. Chem., vol. 72, No. 11, 2159-2166, 2000.*

* cited by examiner

*Primary Examiner*—Sikha Roy
(74) *Attorney, Agent, or Firm*—Duane Morris LLP

(57) ABSTRACT

A metal halide lamp having a high pressure quartz arc tube in which the electrodes are non-thoriated.

20 Claims, 4 Drawing Sheets

DOPANT-FREE TUNGSTEN ELECTRODES IN METAL HALIDE LAMPS

RELATED APPLICATIONS

This application claims the priority of U.S. Provisional Application Ser. No. 60/488,348 entitled "Dopant-Free Tungsten Electrodes in Metal Halide Lamps and Methods" filed Jul. 21, 2003.

BACKGROUND OF THE INVENTION

Metal halide lamps typically include a quartz arc tube having metal electrodes and a lamp fill material including halides of sodium, scandium or one or more of the rare earth metals, or combinations thereof. In addition, thorium oxide $ThO_2$ and scandium Sc or cadmium Cd metals may be added to improve lumen maintenance.

Lumen depreciation and voltage rise in metal halide lamps are due in part to arc tube blackening, sodium loss or a loss of chemical species from halide reaction with the arc tube wall or electrodes.

Early metal halide lamps used pure tungsten electrodes which suffered from sputtering of the tungsten from the electrodes onto the arc tube wall during start-up, a high evaporation rate and the lack of a regenerative cycle during normal operation. Electrode material may also be chemically transported to the arc tube wall as halides.

Wall blackening has long been addressed by the doping of the electrodes with a suitable electron emissive material. The dopant reduces the work function of the electrode and results in a shorter glow-to-arc transition period and a lower electrode tip temperature. This in turn reduces the sputtering and evaporation of tungsten which causes blackening of the arc tube and lumen depreciation. Thorium oxide $ThO_2$ in concentrations of 1% to 2% by weight is commonly used as the dopant, but is radioactive and difficult to manufacture.

The need for metal halide lamps with high efficacy, good lumen maintenance and long life is ever increasing. This has led to the development in recent years of sodium scandium metal halide lamps in which the arc tubes have a high wall loading to improve their performance. The increased arc tube loading has resulted in an increased voltage rise over the life of the lamp, a higher rate of lumen depreciation and a shorter lamp life.

In quartz metal halide lamps containing rare earth halides such as $ScI_3$ and thoriated electrodes, a continuous increase in $ThI_4$ content in the fill has been observed as the lamps are burned, thereby resulting in a continuous drop in light output over the life of the lamp. The present invention addresses the continuous increase of $ThI_4$ in metal halide lamps with thoriated electrodes by eliminating the doping of the electrodes. The elimination of $ThO_2$ in the electrodes reduces the chemical reaction of $ScI_3$ in the fill with the $ThO_2$ in the electrodes, and thus reduces the amount of $ThI_4$ formed. The reduction of $ThI_4$ reduces the operating voltage of the lamp.

Accordingly, it is an object of the present invention to obviate many of the deficiencies in the prior art and to provide a novel high pressure metal halide arc tube and lamp with good lumen maintenance and long life by eliminating the doping in the electrodes.

This and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 2:
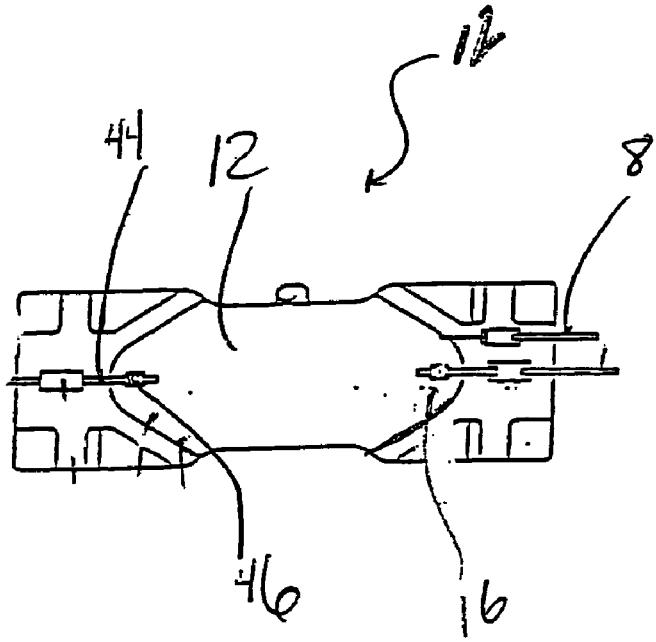
FIG. 2 is an illustration of one embodiment of a pinched body arc tube in accordance with the present invention.
Figure 3:
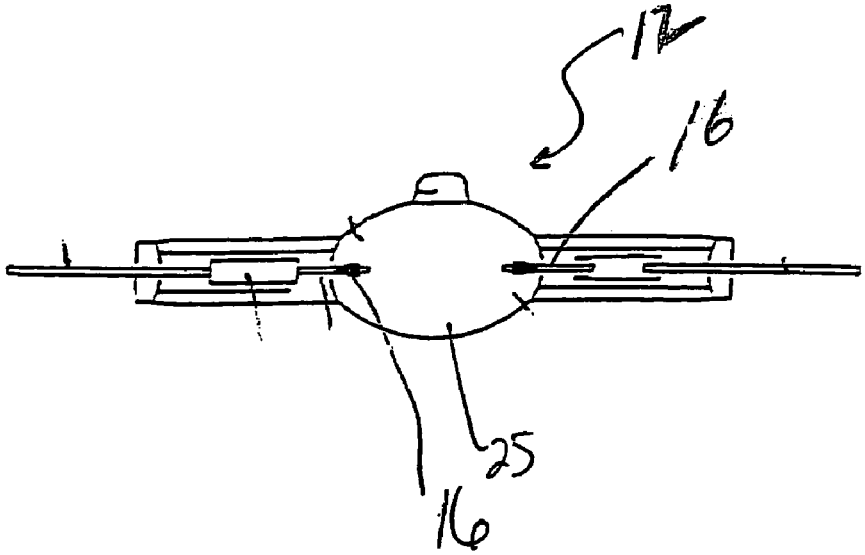
FIG. 3 is an illustration of one embodiment of a formed body arc tube in accordance with the present invention.

With reference to the figures where like elements have been given like numerical designations to facilitate an understanding of the present invention, metal halide lamps 10 generally include light emitting chemicals at a specific pressure that are hermetically sealed within an arc tube 12 formed from light transmitting material such as ceramics or quartz glass. The arc tube 12 may comprise a pinched body or a formed body as illustrated in FIGS. 2 and 3, both containing an ionizable lamp fill material. The arc tube 12 is mechanically supported and electrically coupled within a conventional outer lamp envelope 14 provided with a conventional base 16. There are many known configurations for the arc tube mounting structure and open configurations generally include a tubular shroud formed from light transmitting material positioned around the arc tube 12 to provide protection in the event of a catastrophic failure of the arc tube.

Figure 4:
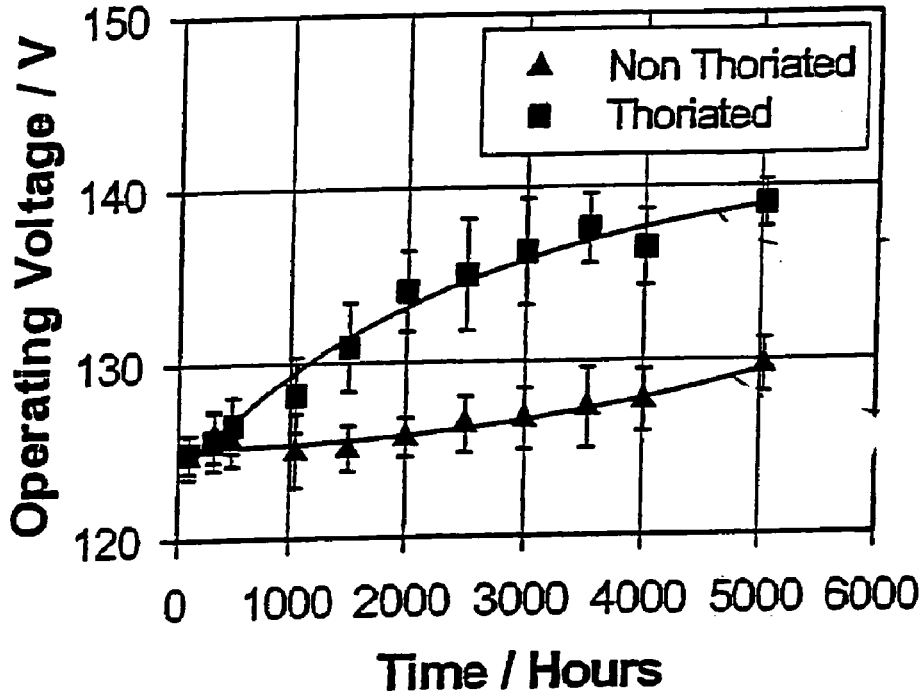
FIG. 4 is a plot over time of the operating voltage rise of lamps with pure tungsten electrodes and thoriated tungsten electrodes.

As shown in FIGS. 2-4, the arc tube 12 comprises an envelope 14 of vitreous material sealed at both ends with electrodes 16 projecting into the interior of the arc tube from the ends thereof. The electrodes 16 typically comprise a shank of tungsten wire about which a smaller diameter tungsten wire is coiled to radiate heat and cool the electrode.

Experiments were conducted using 350 watt pulse-start quartz metal halide lamps using a NaI-$ScI_3$-$ThI_4$ dose and excess Sc. One set of lamps had pure tungsten electrodes whereas a second set of lamps included thoriated tungsten electrodes. The lamps were burned for 5000 hours in a base-up orientation and lamps were removed from each set at specific intervals for analysis.

Figure 5:
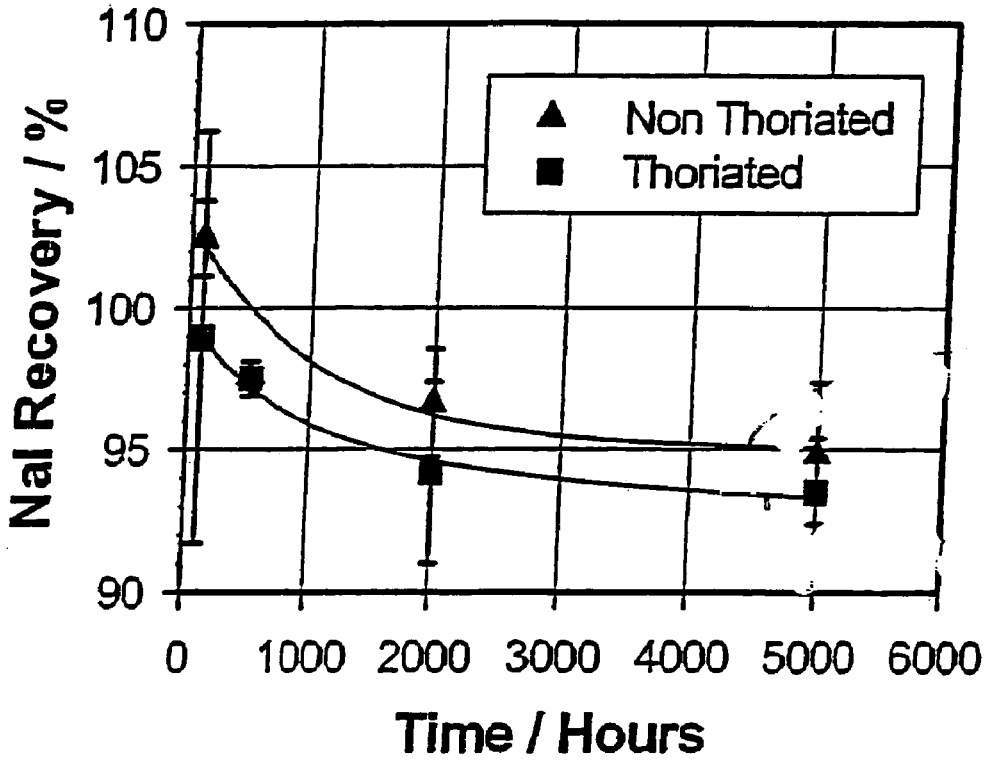
FIG. 5 is a plot of the amount of NaI experimentally recovered over time from lamps with pure tungsten electrodes and thoriated tungsten electrodes as a percentage of the initial dose.
Figure 6:
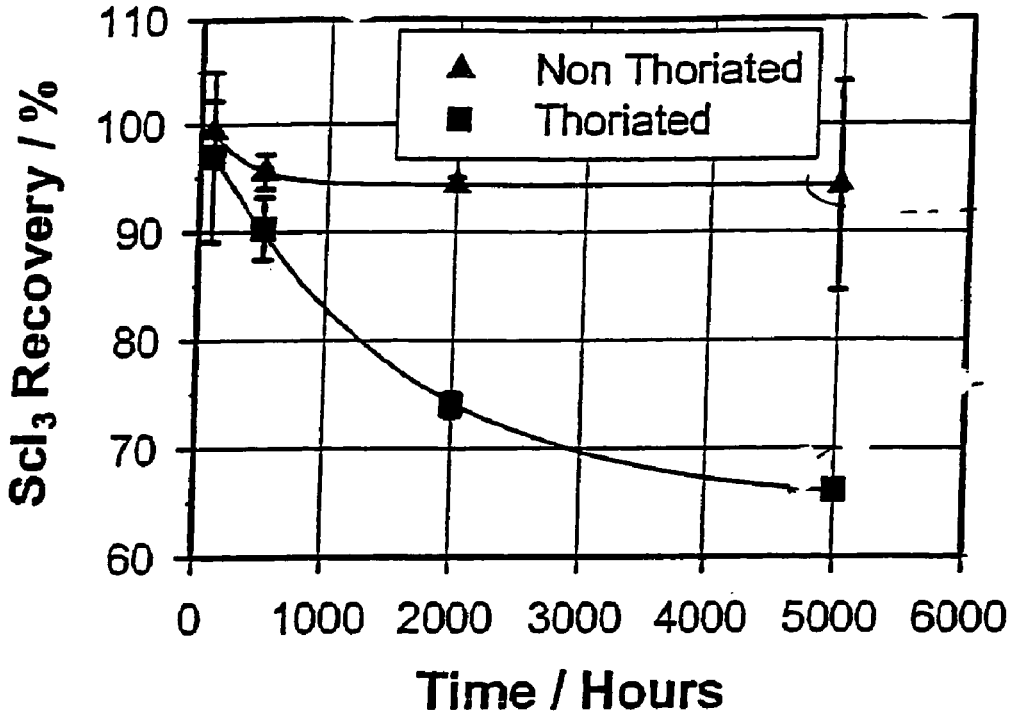
FIG. 6 is a plot of the amount of $ScI_3$ experimentally recovered over time from lamps with pure tungsten electrodes and thoriated tungsten electrodes as a percentage of the initial dose.
Figure 7:
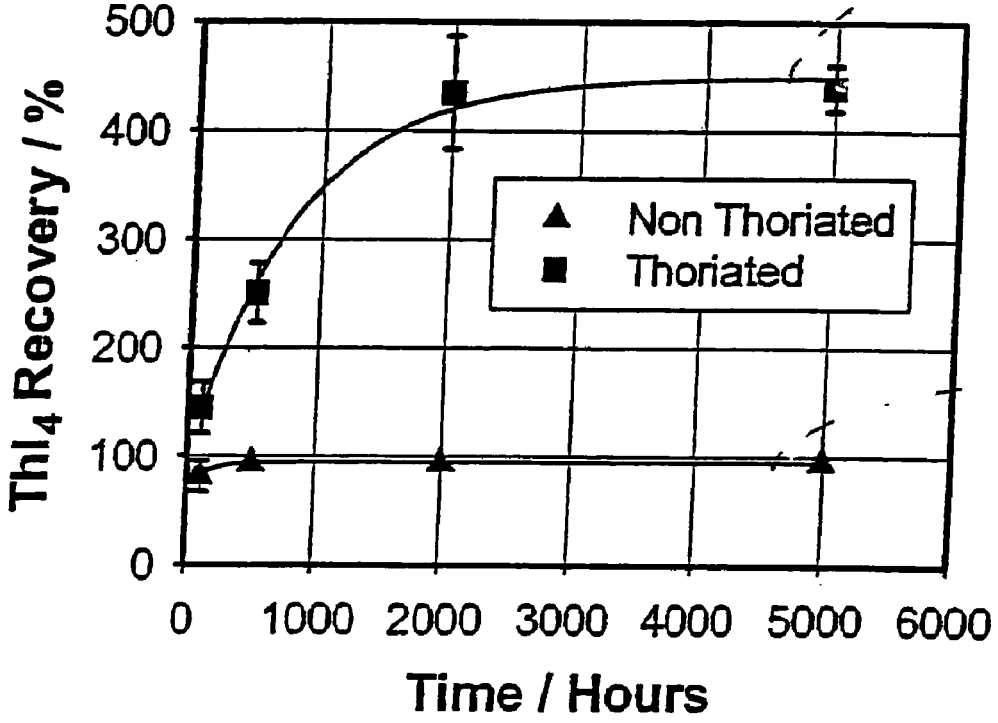
FIG. 7 is a plot of the amount of $ThI_4$ experimentally recovered over time from lamps with pure tungsten electrodes and thoriated tungsten electrodes as a percentage of the initial dose.

FIG. 4 shows that the rise in the operating voltage of lamps with pure tungsten electrodes is less than about 4% over 5,000 operating hours, which is significantly less than the rise for thoriated tungsten electrodes. FIGS. 5 and 6 show that the amounts of NaI and $ScI_3$, respectively, recovered from lamps with pure tungsten electrodes as a percentage of the initial dose is significantly greater that with thoriated tungsten electrodes. Similarly, FIG. 7 shows that the amount of $ThI_4$ recovered from lamps with pure tungsten electrodes as a percentage of the initial dose is significantly lower than with thoriated tungsten electrodes.

As indicated earlier, lamp performance depends on the availability of chemical species in the arc tube. Scandium iodide $ScI_3$, for example, can be consumed by reaction with the quartz wall ($SiO_2$) of the arc tube as well as by reaction with the thorium oxide ($ThO_2$.) in the electrodes, i.e., the loss of $ScI_3$ as shown in FIG. 7 may be accounted for by the following chemical reactions:

$$\text{arc tube wall: } 4ScI_3+7SiO_2 \rightarrow 3SiI_4+2Sc_2Si_2O_7 \quad (1)$$

$$\text{electrodes: } 4ScI_3+3ThO_2 \rightarrow 2Sc_2O_3+3ThI_4 \quad (2)$$

The increase in $ThI_4$ content in lamps having thoriated tungsten electrodes and the constant value of $ThI_4$ in lamps having pure tungsten electrodes demonstrates the significance of reaction (2) in the depletion of $ScI_3$.

Figure 1:
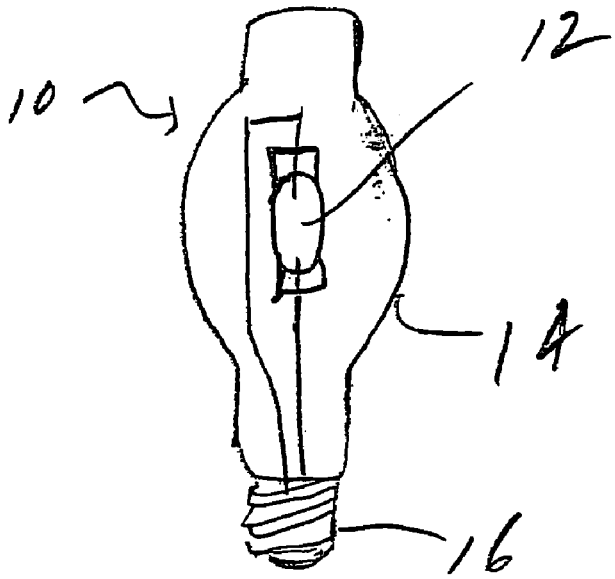
FIG. 1 is a pictorial view of one embodiment of the lamp of the present invention.
Figure 8:
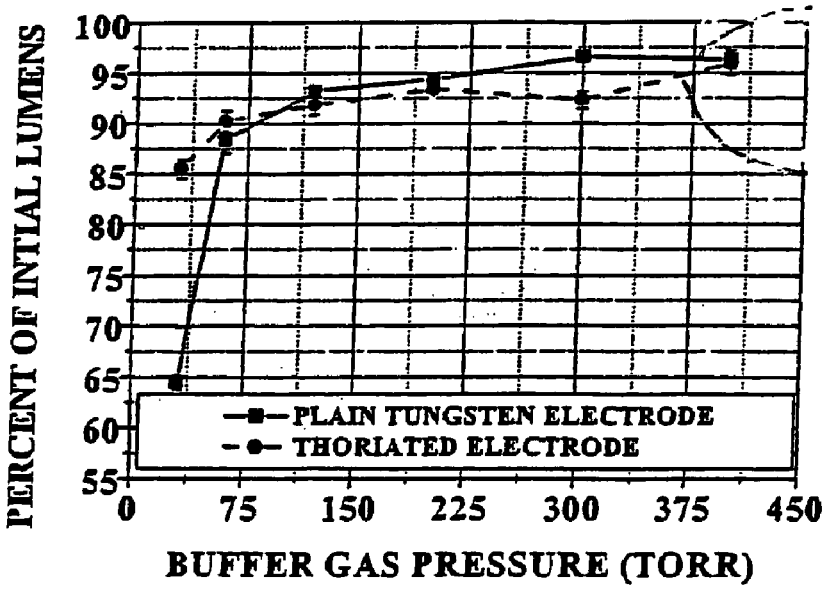
FIG. 8 is a plot of the initial lumens experimentally determined as a function of the change in buffer gas pressure.

In an experiment to measure lumen maintenance at buffer gas pressures between 30 torr and 400 torr, the performance of 350 Watt sodium scandium lamps using pure tungsten electrodes was compared with similar lamps using thoriated tungsten electrodes containing 2% $ThO_2$. Lamps were cycled for 2 minutes on and 30 minutes off in a vertical orientation, and FIG. 8 is a diagram showing 350 watt lumen maintenance as a function of buffer gas pressure at 200 cycles. As shown in FIG. 8, the pure tungsten electrode lamp lumen performance exceeds the thoriated tungsten electrode lamp performance at higher fill gas pressures.

Further tests were conducted to determine if the performance of metal halide lamps with pure tungsten electrodes could be improved using high frequency ballasts. The performance of 350 Watt sodium scandium pulse start lamps with excess scandium and $ThI_4$ using pure tungsten electrodes was compared with similar lamps using thoriated tungsten electrodes. Lamps were operated on a 10 hours on and 1 hour off cycle in a vertical orientation on a high frequency (100 kHz) ballast. Pure tungsten electrode lumen maintenance was experimentally determined to be significantly better than thoriated electrode lumen maintenance. It is to be understood that the frequency of the ballast will depend upon the lamp requirements and may have a frequency greater than 100 kHz.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A metal halide lamp having a base, an outer envelope, and a quartz arc tube, said arc tube having un-doped tungsten electrodes and a lamp fill material containing scandium metal, a thorium halide, and at least one halide of a metal within the group comprising scandium and rare earth metals at an operating pressure of at least 30 torr.

2. The metal halide lamp of claim 1 wherein the thorium halide is an iodide.

3. The metal halide lamp of claim 1 wherein the operating pressure is between about 100 torr and about 400 torr.

4. The metal halide lamp of claim 1 including an electronic ballast.

5. A metal halide lamp having a base, an outer envelope, and a quartz arc tube, said arc tube having un-doped tungsten electrodes and a lamp fill material containing scandium metal and at least one halide of a metal within the group comprising scandium and rare earth metals at an operating pressure of at least 30 torr;

wherein the lamp fill material includes sodium, scandium, and thorium.

6. An arc tube for a metal halide lamp comprising:

a quartz arc tube envelope;

two un-doped tungsten electrodes extending into said arc tube envelope from which an electric arc may be struck; and lamp fill material disposed interiorly of said arc tube envelope containing scandium metal, a thorium halide, and at least one halide of a metal from the group consisting of scandium and rare earth metals at an operating pressure of at least 30 torr.

7. The arc tube of claim 6 wherein the thorium halide is an iodide.

8. The arc tube of claim 6 wherein the operating pressure is between about 100 torr and about 400 torr.

9. The arc tube of claim 6 including an electronic ballast.

10. An arc tube for a metal halide lamp comprising:

a quartz arc tube envelope;

two un-doped tungsten electrodes extending into said arc tube envelope from which an electric arc may be struck; and lamp fill material disposed interiorly of said arc tube envelope containing scandium metal and at least one halide of a metal from the group consisting of scandium and rare earth metals at an operating pressure of at least 30 torr;

wherein the lamp fill material includes sodium, scandium, and thorium.

11. A quartz arc tube for a high pressure metal halide lamp in which the electrodes are essentially free of thorium and in which the lamp fill material contains halides of sodium, thorium and scandium and excess scandium.

12. The quartz arc tube of claim 11 wherein the fill pressure is between 100 and about 400 torr.

13. A lamp comprising:

a quartz arc tube;

a pair of non-thoriated tungsten electrodes; and a fill material comprising scandium metal and a thorium halide.

14. The lamp of claim 13 wherein the fill material comprises at least one halide of a metal within the group comprising scandium and rare earth metals.

15. The lamp of claim 14 wherein the fill material comprises halides of sodium and scandium.

16. A quartz arc tube for a high pressure metal halide lamp comprising:

un-doped tungsten electrodes; and lamp fill material including halides of sodium, thorium and scandium and excess scandium, wherein the operating voltage increases less than about 4% over 5,000 operating hours.

17. The arc tube of claim 16 wherein un-doped tungsten electrodes comprises a shank of un-doped tungsten wire about which a smaller diameter un-doped tungsten wire is coiled.

18. The arc tube of claim 16 further comprising an electronic ballast.

19. The arc tube of claim 18 wherein the electronic ballast is configured to operate at above about 100 khz.

20. The arc tube of claim 16 wherein the pressure is over 100 torr.

* * * * *